US010737455B2

(12) United States Patent
Fichtner et al.

(10) Patent No.: US 10,737,455 B2
(45) Date of Patent: Aug. 11, 2020

(54) METHOD AND MACHINE FOR MANUFACTURING A BAG COMPRISING HANDLE

(71) Applicant: Holweg Group, Molsheim (FR)

(72) Inventors: Thomas Fichtner, Besancon (FR); Vincent Schalck, Holtzheim (FR)

(73) Assignee: HOLWEG GROUP, Molsheim (FR)

( * ) Notice: Subject to any disclaimer, the term of this patent is extended or adjusted under 35 U.S.C. 154(b) by 159 days.

(21) Appl. No.: 15/768,232

(22) PCT Filed: Oct. 11, 2016

(86) PCT No.: PCT/FR2016/052623
§ 371 (c)(1),
(2) Date: Apr. 13, 2018

(87) PCT Pub. No.: WO2017/064409
PCT Pub. Date: Apr. 20, 2017

(65) Prior Publication Data

US 2018/0319115 A1 Nov. 8, 2018

(30) Foreign Application Priority Data

Oct. 11, 2016 (FR) ..... 15 59858

(51) Int. Cl.
*B31B 70/86* (2017.01)
*B31D 1/06* (2006.01)
(Continued)

(52) U.S. Cl.
CPC ..... *B31B 70/864* (2017.08); *B31B 70/81* (2017.08); *B31B 70/876* (2017.08); *B31D 1/06* (2013.01); *B31B 2160/10* (2017.08)

(58) Field of Classification Search
CPC ..... B31B 19/86; B31B 70/00; B31B 2160/10; B31B 70/864; B31B 160/10
(Continued)

(56) References Cited

U.S. PATENT DOCUMENTS 2,985,355 A * 5/1961 Read ..... B65D 33/02 383/6
3,439,591 A * 4/1969 Class ..... B31B 70/00 493/221
(Continued)

FOREIGN PATENT DOCUMENTS

DE 16 11 657 1/1971
DE 1611657 B * 7/1976 ..... B31B 19/86
(Continued)

OTHER PUBLICATIONS

Erk Dr-Ing Amir, Continuous carrier bag production uses conveyor system including fitting of carrying handles with transverse reinforcement strip (Year: 1976).*
(Continued)

*Primary Examiner* — Hemant Desai
*Assistant Examiner* — Jacob A Smith
(74) *Attorney, Agent, or Firm* — Brinks Gilson & Lione

(57) ABSTRACT

A method for manufacturing a bag includes a wall of the bag is passed along a placement drum for rotatably mounted handles; a handle is hooked onto the drum, legs of the handle extending backwards along a perimeter of the drum in the direction of rotation of the drum, the legs being connected by a cross member; same is completely turned over using a turnover drum so that the legs are at the front on the placement drum; and the handle is deposited on the wall.

13 Claims, 7 Drawing Sheets

(51) Int. Cl.
*B31B 70/81* (2017.01)
*B31B 160/10* (2017.01)

(58) Field of Classification Search
USPC .... 493/226, 926, 51, 68, 221, 231, 234, 244
See application file for complete search history.

(56) References Cited

U.S. PATENT DOCUMENTS 3,713,940 A * 1/1973 Haugh, Jr. ..... B31B 70/00 156/250
3,722,377 A * 3/1973 Hayes ..... B65D 33/105 493/221
5,378,220 A * 1/1995 Bunn ..... B65F 1/0006 383/104
5,382,215 A * 1/1995 Mattiebe ..... B31B 70/00 493/221
5,421,802 A * 6/1995 Landeck ..... B31B 70/00 493/14
5,421,805 A * 6/1995 Baxter ..... B31B 70/00 493/226
5,447,486 A * 9/1995 Anderson ..... B26D 5/20 493/11
5,609,556 A * 3/1997 Rostalski ..... B31B 70/00 493/226
5,980,441 A * 11/1999 Kolbe ..... B31B 70/00 493/226
6,059,709 A * 5/2000 Achelpohl ..... B31B 70/00 493/226
6,117,058 A * 9/2000 Sauder ..... B31B 70/00 493/193
6,574,940 B2 * 6/2003 Dauder Guardiola .... B65B 9/13 493/226
8,764,618 B2 * 7/2014 Castro ..... B31B 50/00 493/243
2005/0119101 A1 * 6/2005 Constant ..... B31B 70/00 493/221
2006/0233466 A1 * 10/2006 Mantzivis ..... B65D 33/10 383/21
2008/0187252 A1 * 8/2008 Dabrazzi ..... B65D 81/03 383/12
2013/0044966 A1 * 2/2013 Binger ..... B65D 33/28 383/105
2013/0267400 A1 * 10/2013 Robinson ..... B31B 70/00 493/227
2015/0030262 A1 * 1/2015 Van Den Berg ..... B31B 50/86 383/29
2015/0141228 A1 * 5/2015 Schalck ..... B31B 70/00 493/241
2016/0176144 A1 * 6/2016 Johnson ..... B29C 65/38 493/193

FOREIGN PATENT DOCUMENTS

DE 1611657 B * 7/1976 ..... B31B 19/86
WO WO 2013/190208 12/2013

OTHER PUBLICATIONS

International Search Report dated Dec. 12, 2016 (5 pages including English translation) from PCT/FR2016/052623.

* cited by examiner

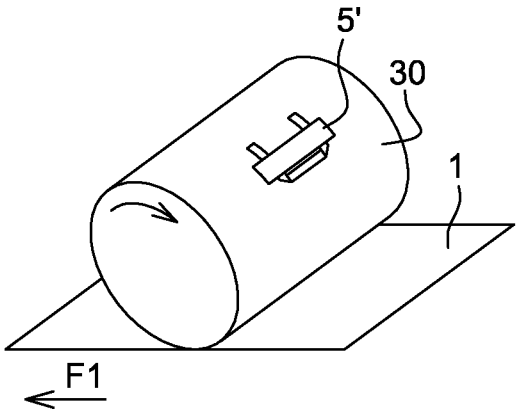
Fig. 15
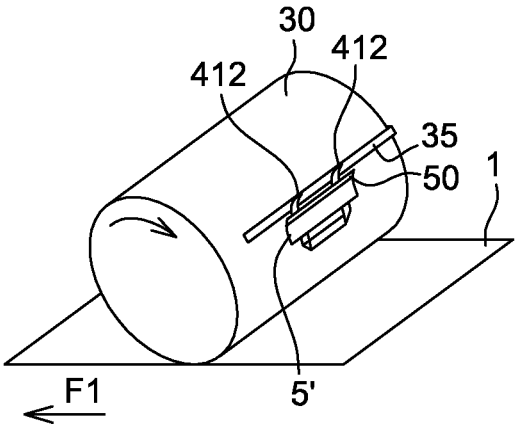
Fig. 16
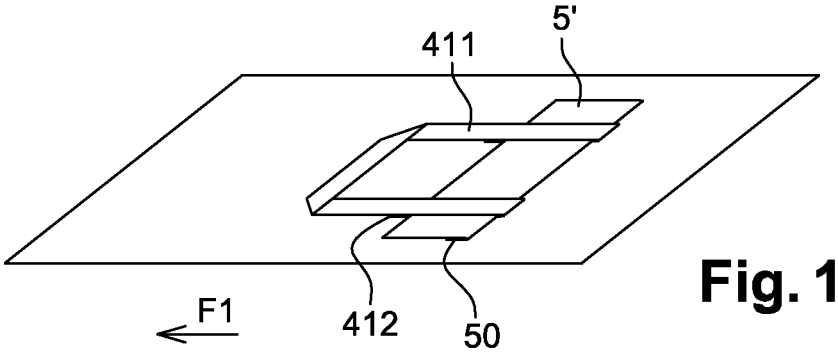
Fig. 17
Fig. 18
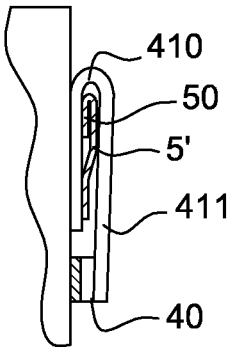

METHOD AND MACHINE FOR MANUFACTURING A BAG COMPRISING HANDLE

This application claims priority to International Application No. PCT/FR2016/052623 filed Oct. 11, 2016 and to French Application No. 1559858 filed Oct. 16, 2015; the entire contents of each are incorporated herein by reference.

TECHNICAL FIELD

The present invention relates to a method and a machine for making bags such as square bottom bags, having flat handles made of folded, cut, or glued materials.

STATE OF THE ART

Bags are used, especially in sales, for customers to carry their purchases. Such bags are often made, partially or entirely, of pape and comprise a tubular portion open at one end and closed at the other end with, for example, a rectangular- or square-shaped base. These bags are called square bottom bags. Some of these handles bags are equipped in order to carry them easily.

U.S. Pat. No. 3,439,591 discloses a bag making method including such handles. Starting from a continuous paper web, transverse cuts are made and U-shaped handles are placed on either side of the notches, by bonding the legs of the handles onto the paper web on just one side of the notch. Backing sheets are attached by bonding to each leg in order to strengthen the connection with the wall of the bag. Then, the strip is folded back on itself to form a hollow body, which is cut into sections along the notches. A bottom is formed by folding and bonding the tabs to the end of the section opposite to that carrying the handles. The bag is thus completed, with handles which project from the open end of the bag. This document also shows a handle manufacturing station. Such a machine requires a specific stacking station, due to congestion of the handles which project from the body of the bag.

The handles are produced on a fixed station. During said production, the legs of the handles are oriented in the direction that the paper web runs. The legs are clamped between a cylinder which guides the paper web and a segment conveyance. The movement of the handles is brusque, the handles to move from a very low speed to the high speed of the running belt. This insertion of the handles is a cause for limiting the production rate of the bags.

U.S. Pat. No. 5,609,556 proposes to provide the handles that do not project beyond the bag opening. This reduces bag congestion for storage and transport. For this purpose, the handle is formed on a rotatable drum, the periphery of which is tangential to the path of the wall. The drum receives a piece of material previously cut along a template forming a strap which it holds at two points. The strap is retained during rotation of the drum so as to bend near the holding points at an oblique fold and form the legs of the handle at right angles to a cross-piece held between the two holding points. Then, the legs of the handles are folded on themselves by a folding station for forming a base, before being deposited and bonded by the base of the bag wall. At the folding station, a blade carried by a folding roller marks the fold on the legs, making the bases stand out. A folding bar, which moves faster than the periphery of the drum causes the bases to collapse onto the legs.

Holding means temporarily attach the handle along the wall of the bag until the bag user goes against these holding means to deploy the handle. However, this provision does not allow for backing sheets since the space normally taken up by such sheets is already occupied by the folded handle. Thus, the load that can be carried in such bags is limited. In addition, when using the bag, the user goes counter to the temporary holding means by spreading the handles from each other. Finally, a concentrated traction is exerted particularly on the bonding of the base to the wall at the junction with the remainder of the handle. This degree of traction is likely to initiate a rapid tearing at either the wall or the bonding.

Furthermore, using a drum for installing handles provides greater throughput, since the handle has already reached the speed of the paper web.

DESCRIPTION OF THE INVENTION

The invention therefore aims to provide a method of manufacturing a bag with handles, with or without backing sheets, at high speeds and a machine implementing such a method.

With these objectives in mind, the invention relates to a method of manufacturing a bag in which:

a wall of the bag is passed along a rotatably mounted placement drum for placing handles;

a handle is hung on the placement drum, legs of the handle extending along a perimeter of the placement drum, backward in the direction of rotation of the placement drum, the legs being connected by a cross-piece;

the handle is placed on the wall;

characterized in that before the handle is placed on the wall, said handle is completely turned by a turning drum so that the legs are placed forward on the placement drum.

When turning the handle prior to placement on the wall, the legs of the handle placed on the wall face forward and the cross-piece faces backward as shown in FIG. 7*a*. Typically, the legs are bonded to the wall and the cross-pieces are located beyond the edge of the bag. The placement can be done before the separation of the bags, on the inner or outer side of the bag. In this case, the wall is previously notched transversally so that the handles are placed over these notches, the final cut of the bag being done along the notches. Two handle placement stations are used in this case, arranged side by side or staggered longitudinally. The placement can also be done after the separation of the hollow body into sections before or after the formation of the bottom on the sections, and in this case typically on the outside thereof. As the placement of the handles is a continuous process, without sudden acceleration thereof, the handles can be placed at a high rate, more than 250 per minute.

According to one embodiment, to carry out the turning, the cross-piece of the handle is grasped by the turning drum tangentially to the periphery of the placement drum, a blade carried by the turning drum inserts the ends of the legs in a gripper of the placement drum and the cross-piece is released by bringing the handle against the periphery of the placement drum. The turning is done during continuous rotation of the placement drum and that of the turning drum. In this operation, the handle does not undergo any sudden acceleration, which provides a quick rate. The cross-piece is moved away from the periphery of the placement drum by the turning drum. By grasping the end of the legs, the placement drum drives these beyond the cross-piece which is retained by the turning drum, so that the legs pass forward.

According to an improvement, at least one backing sheet is placed by covering at least partially at least one leg before the turning of the handle. After turning, the backing sheet will be on the side of the placement drum, then overlap the leg or legs being bonded to the wall. This technique is applicable for placing handles both on the inside and outside of the bags. The connection of the handle with the wall is reinforced.

According to another improvement, the rotational speed of the placement drum is adjusted during the rotation of one revolution to place the handle at the speed of the wall and at the interval between two successive bags. This makes it possible to use the process for making bags of variable length, not processed by the perimeter of the drum. In the period between two successive placements, the drum speed is free and may be slowed to allow a greater wall length in order to make long bags, or otherwise accelerated to make short bags. The speed is adjusted again during the placement to match the rate of the wall.

The invention also relates to a machine for producing bags with handles having conveyance means for passing a wall of the bag along a rotatably mounted placement drum for placing handles, attachment means for attaching a handle on the placement drum, legs of the handle extending along a perimeter of the placement drum, backward in the direction of the placement drum, the legs being connected by a cross-piece, the attachment means being configured to place the handle on the wall, characterized in that it comprises a turning drum to turn the handle before placement of the handle on the wall and the legs are placed forward the placement drum.

According to one embodiment, to carry out the turning, the turning drum is rotating and tangential to the periphery of the placement drum and comprises a cross-piece gripper to grasp the handle by the cross-piece during its passage between the placement drum and the turning drum, and a blade capable of inserting the end of the legs into a gripper of the placement drum, the cross-piece gripper being configured to release the cross-piece after grasping of the legs by the leg gripper, the machine further comprising guiding means to return the handle against the periphery of the placement drum after the turning drum and before the laying of the handle on the wall.

According to an improvement, the machine comprises a backing sheet placement station upstream of the turning drum for placing at least one backing sheet which at least partially covers at least one leg.

According to another improvement, the machine includes a control that controls the rotational speed of the placement drum upon rotation of one revolution and for placing the handle at the speed of the wall and at the interval separating two successive bags.

According to various embodiments:

the machine comprises a station for forming a hollow body placed downstream of the placement drum;

the machine comprises a station for forming a hollow body placed upstream of the placement drum and a bottom forming station downstream of the placement drum;

the machine comprises a station for forming a hollow body placed upstream of a bottom forming station, which is upstream of the placement drum.

Alternatively, the turning station is supplemented or replaced by a folding station for folding down the legs in two parts, one on the other along a fold line, the crossing part being called tab while the remaining part is called the base. Thus, the bonding of the handle to the wall is done by the bases, the cross-piece being closer to the bottom. When using the folding station, the turning station is removed or is not used. The turning station can also be transformed into a folding station, as will be seen better later. By this provision, the machine can be used for producing different models, with straight handles that project from the edge of the bag or with folded handles that do not project from the edge.

For folding, according to one embodiment, a guide bar is used that moves faster than the periphery of the drum for moving and folding down the bases onto the tabs.

As an improvement, a backing sheet placement station is also used to cover at least partially the base of at least one leg prior to folding the base by bonding the backing sheet on the base and the wall.

According to other embodiments:

the backing sheet is placed in such a position so that the backing sheet is folded with the bases during the folding operation. A flap is thus formed without adding any special means for folding same, taking advantage of the leg bending operation. Such a flap enhances tear strength of the backing sheet, in a particularly stressed area.

the bases are glued before being folded against the backing sheet.

BRIEF DESCRIPTION OF FIGURES

The invention will be better understood and other features and advantages will become apparent from reading the description which follows, with the description referring to the appended drawings in which:

FIGS. 15 and 16 are views similar to FIGS. 9 and 10 respectively during the manufacture of a bag according to a second variation of the fourth embodiment of the invention;

FIGS. 17 and 18 are views similar to FIGS. 13 and 14 respectively of the bag manufactured according to the method of FIGS. 15 and 16.

DETAILED DESCRIPTION

Figure 1:
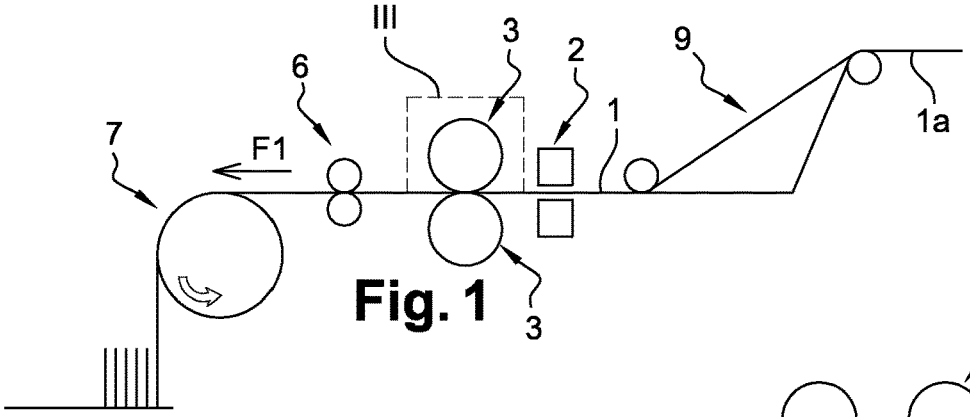
FIG. 1 shows a side view of a machine for producing bags according to a first embodiment of the invention.

A bag making machine according to a first embodiment of the invention, as shown in FIG. 1, comprises, in a manner known per se, a station 9 for forming a hollow body 1 from a web of flexible material such as plain or pre-printed paper, aluminium foil or plastic or equivalent or a mixture of said materials. The web 1*a* of material is unwound from a coil on a reel, not shown. It can be printed before or after exiting of the reel. The hollow body 1 is usually formed with gussets, but this feature does not affect the invention which could be implemented on bags without gussets. The machine then comprises successively, in the conveying direction of the hollow body 1, two bonding stations 2, two handle placement stations 3 according to the invention and facing one another, a cutting station 6, a bottom forming station 7 and a stacking station 8. WO 2013/190208 A1 shows an example of the bottom forming station 7. The handle placement stations 3 comprise placement drums 30 placed opposite from each other to place the handles on either of the walls of the hollow body 1, so that the handles will be on the outside of the bag.

Figure 2:
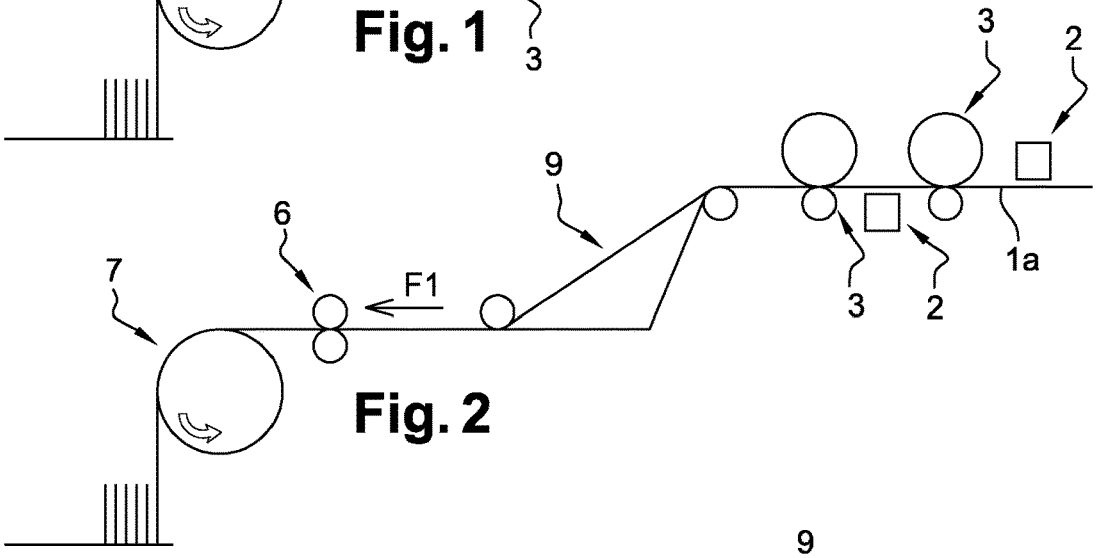
FIG. 2 is a view similar to FIG. 1 of a machine according to a second embodiment of the invention.

In a second embodiment, wherein the bag has handles on the inside as shown in FIG. 2, the handles 4 are placed on the web 1*a* of material before the formation of the hollow body 1. For this purpose, the machine comprises two handle placement stations 3, arranged offset at the same time along the direction of the web 1*a* of material and transversely to said direction.

Figure 2A:
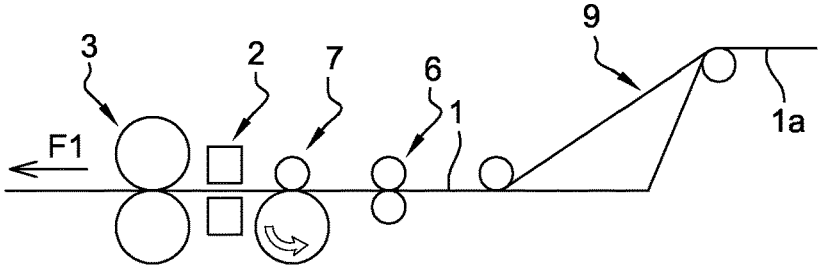
FIG. 2*a* is a view similar to FIG. 1 of a machine according to a third embodiment of the invention.

In a third embodiment, wherein the bag has handles on the outside as shown in FIG. 2*a*, the handles 4 are placed on bags that already formed upon exiting the folding station 7. To this end, both handle placement stations 3 are arranged downstream of the folding station 7, one facing the other.

In a variant not shown, the handles are placed after the cutting of the hollow body into sections but prior to forming the bottom.

Figure 8:
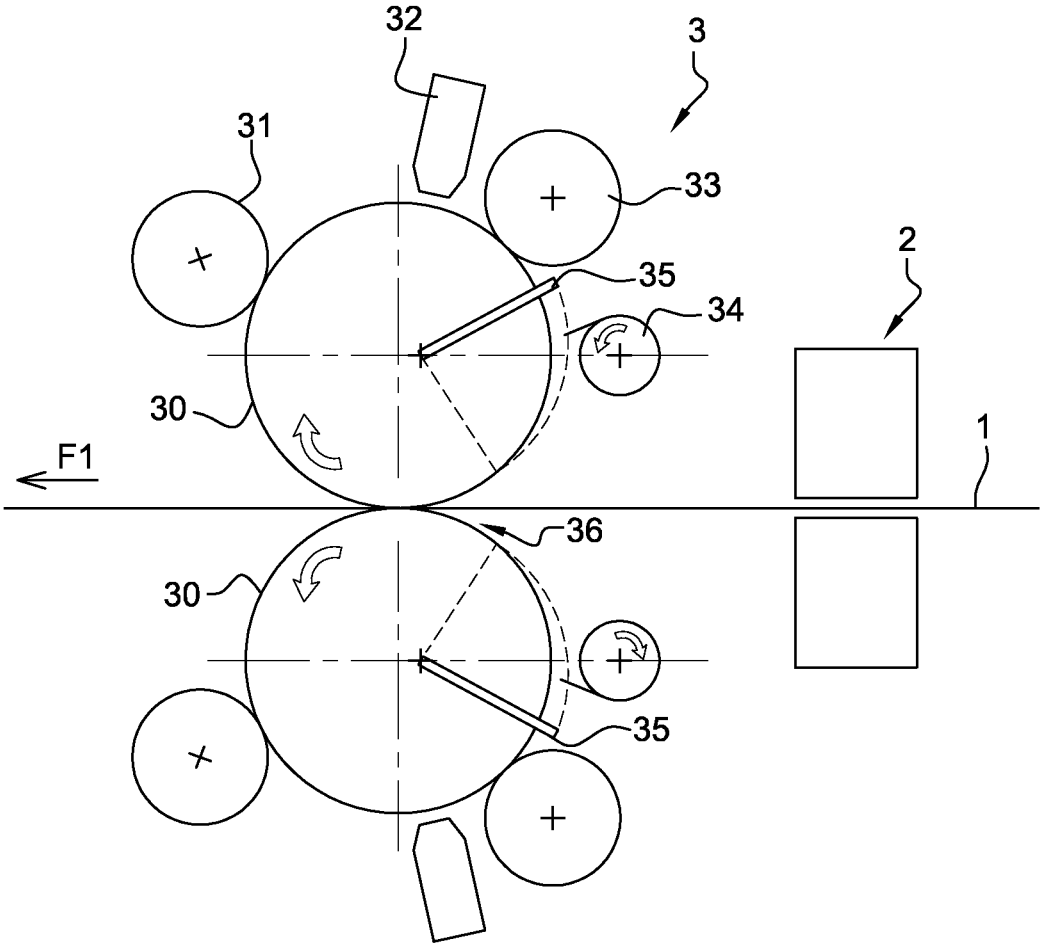
FIG. 8 shows a side view of a machine for producing bags according to a fourth embodiment, by modification of the machine according to the invention and according to a first variant.
Figure 8A:
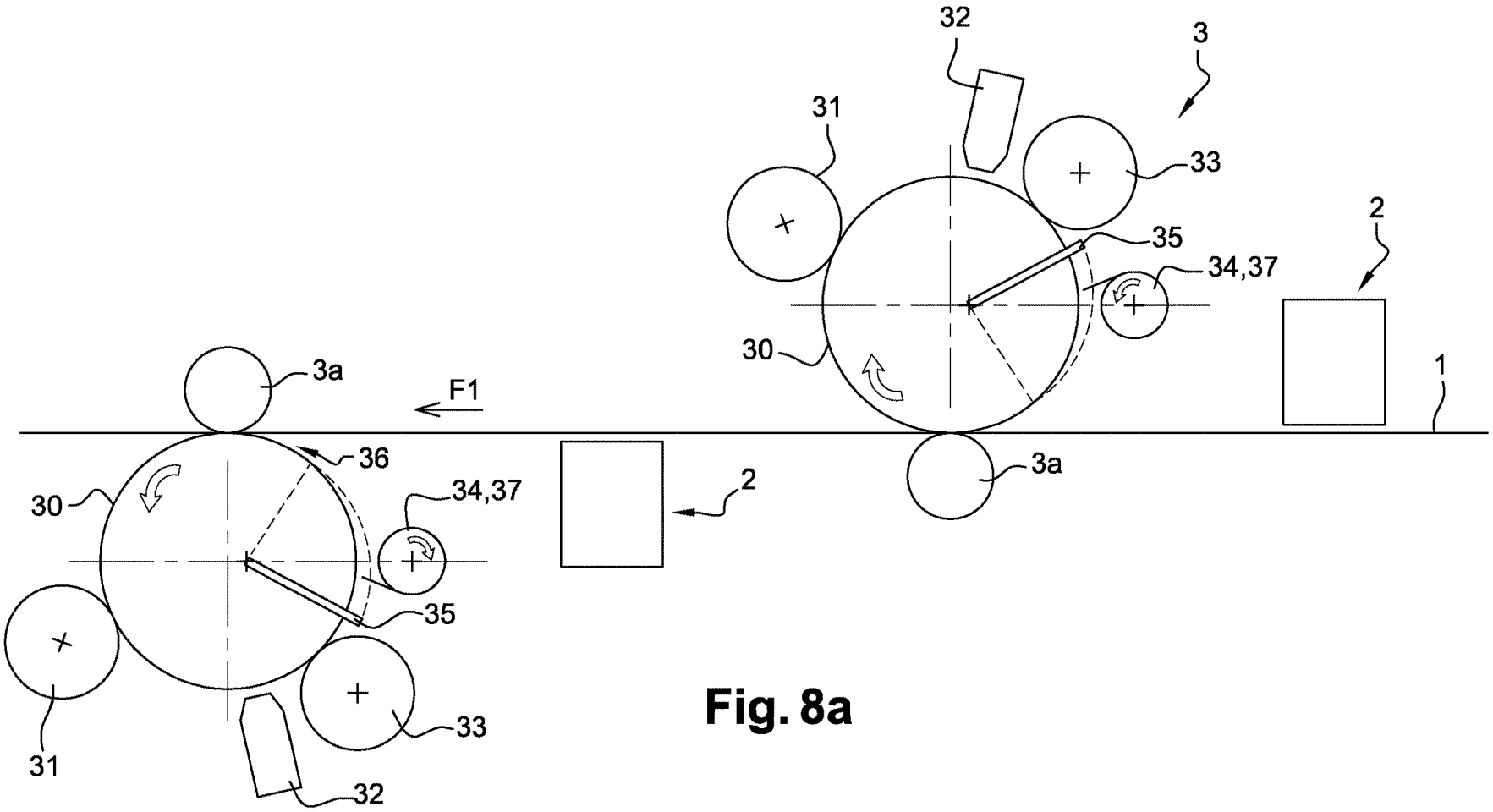
FIG. 8*a* shows a second variant of the first and third embodiments, in which the stations are not facing each other but offset, as in the second embodiment.

FIG. 8*a* shows two bonding stations offset from each individual presser 3*a*.

Figure 3:
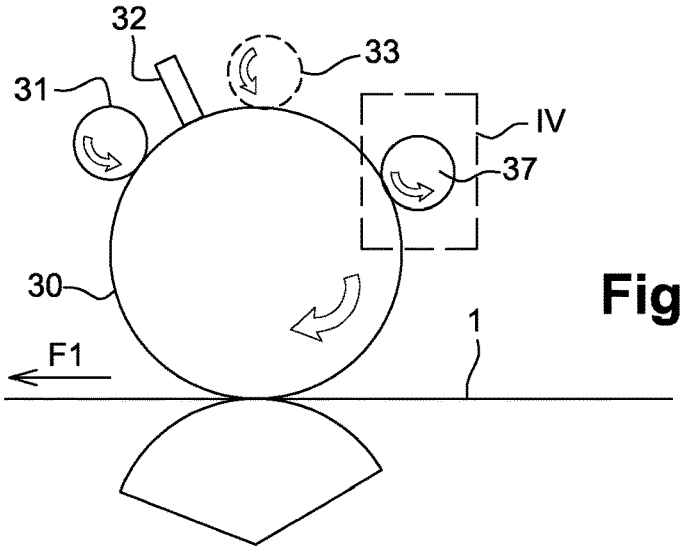
FIG. 3 is a view of the detail III of FIG. 1.

In these three embodiments, handle placement stations 3 are arranged in a similar manner which will now be described with reference to FIGS. 3 to 6. Each handle 4 includes a cross-piece 40 connecting two legs 41 substantially at a right angle, as shown for example, in FIG. 9. Each placement drum 30 is rotated so that its peripheral speed is the same as the running speed of the hollow body 1 which passes in front of same at the time the handles are placed. The handle placement station 3 includes an attachment that attaches the handle 4 on the drum so that the legs 41 of the handle 4 extend along a perimeter of the drum 30 backwards in the direction of the rotation of the drum. Referring to FIG. 3, it further includes a distribution roller 31 to place straps on the drum 30 which will form the handle 4 by folding the legs 41, in a manner which is not detailed here, optionally a device 33 for placing the backing sheet 5, and a turning drum 37 to turn the handle before placing the handle 4 on the wall and the legs 41 are in front of the placement drum. The turning drum 37, counter-rotationally mounted relative to the placement drum, is tangential to the periphery of the placement drum 30 and includes a cross-piece gripper 370 to grasp the handle by the cross-piece 40 as it passes between the placement drum 30 and the turning drum 37 and a blade 371 that is capable of inserting the end of the legs 41 in a leg clamp 302 of the placement drum 30. The cross-piece gripper 370 is configured to release the cross-piece 40 after pinching the legs 41 by the leg gripper 302. The placement station 3 further includes a guide 38 that returns the handle against the periphery of the placement drum 30 after the turning drum 37 and before the placement of the handle 4 on the wall 1.

The bonding station 2 places glue on the wall 1 in the zones intended to receive the legs 41 of the handles 4 and the optional backing sheet 5.

Figure 4:
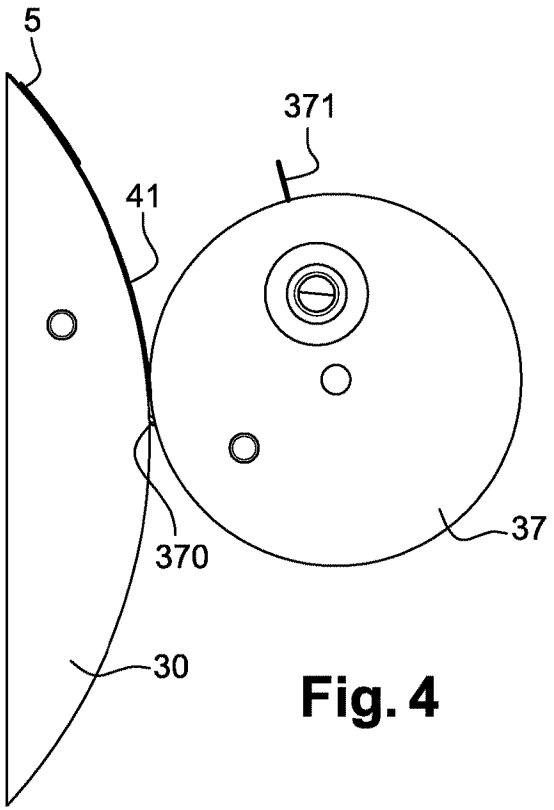
FIGS. 4 to 7 are views of detail IV of FIG. 3 in different phases of the method implemented by the machine.
Figure 4A:
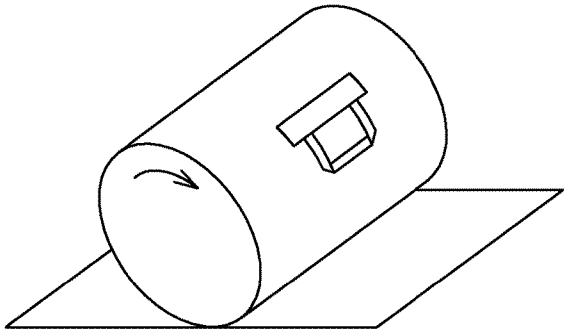
FIGS. 4*a* and 7*a* are perspective views of the placement drum at a position corresponding to that of FIGS. 4 and 7.
Figure 5:
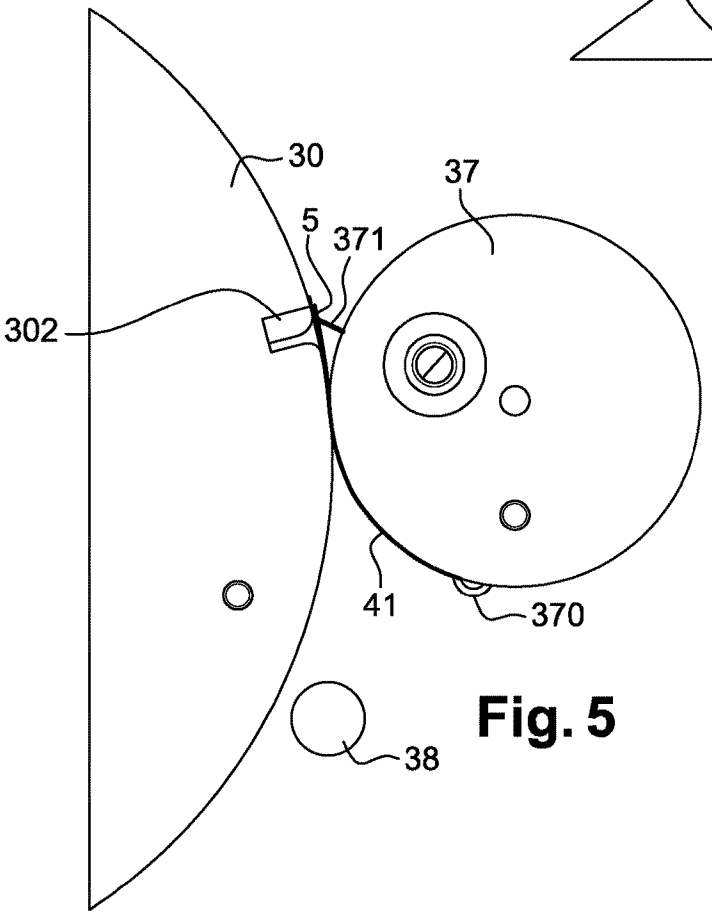
Figure 6:
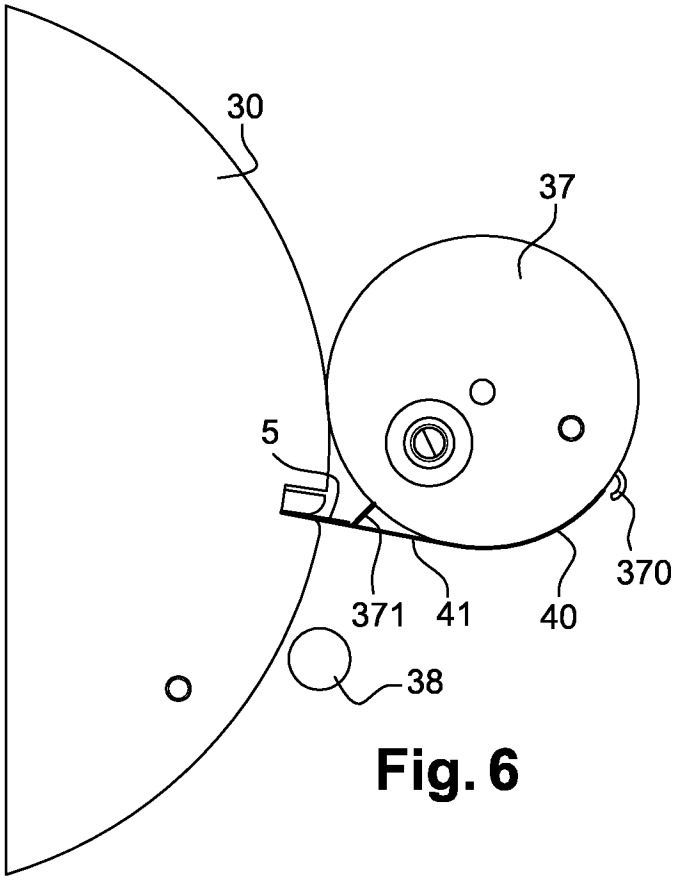
Figure 7A:
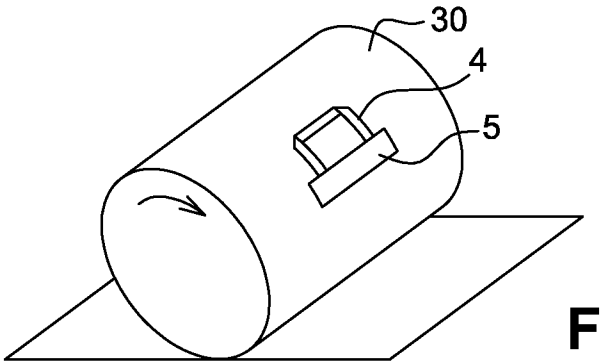
Figure 7:
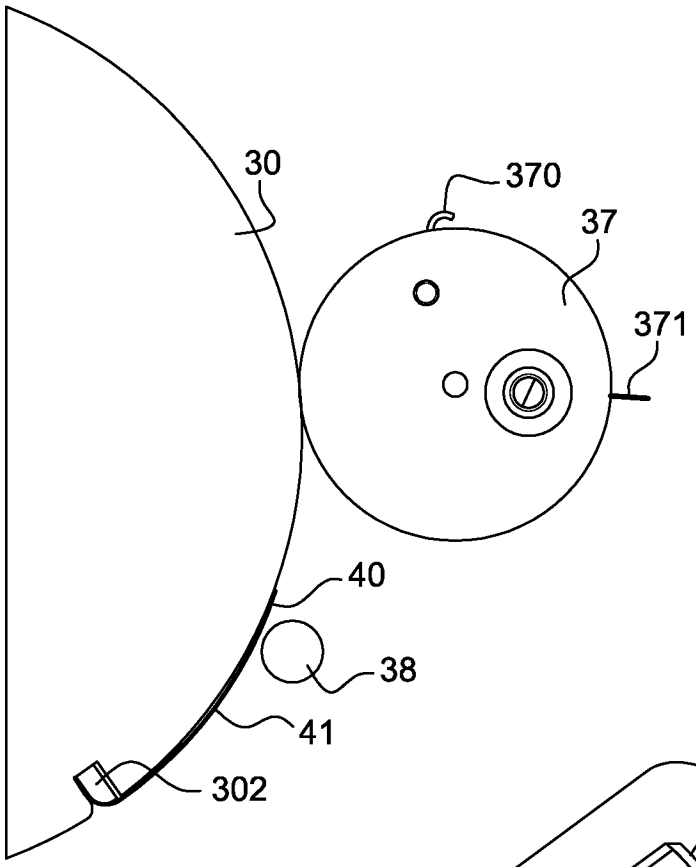

During operation, a strap is placed by the distribution roller 31 on the placement drum 30 and maintained thereon by the gripper that grips the cross-piece 40, during the formation of the handle 4. The parts of the strap on either side of the cross-piece 40 are bent to 45° to form the legs 41° to 90° with respect to the cross-piece 40. In the event that the placement device 33 is present and operational, glue is placed on the legs 41 by the device 32 and a backing sheet 5 is placed on the legs 41 of the handle 4. When the cross-piece 40 arrives at the turning drum 37, the latter is gripped by the cross-piece gripper 370 thereof, as shown in FIG. 4, and released by the attachment. The turning drum 37 rotates the cross-piece 40 therewith, as shown in FIG. 5. The blade 371 then arrives at the end of the legs 41 and pushes the latter between the leg gripper jaws 302. The jaws grip the end of the legs 41, while the blade 371 releases. The cross-piece 40 is then released by the cross-piece gripper 370 of the turning drum 37. The guide 38 obstructs the cross-piece 40 and force it to come back to the leg gripper 302 which holds the legs 41, as shown in FIGS. 6 and 7. The optional backing sheet 5 is thus placed between the periphery of the placement drum 30 and the legs 41. Thereafter, the handle 4 is fully turned over, as shown in FIG. 7, and then is deposited on the wall 1 to which glue has been locally applied.

FIG. 8 only shows the bonding station 2 and the handle placement station 3, according to a fourth embodiment using a machine according to the invention. This embodiment differs from the three previous ones in that the placement station has no turning drum 37, but a glue applying device 32 followed by a folding device. In practice the turning drum 37 may be used by neutralizing the gripper 370, and by operating the blade 371 with an offset with another gripper 301. Thus, the same machine can be used to implement the method described above or the one that will be described below.

In this embodiment, the legs 41 are divided into two parts along a folding line 410, the part on the side of the cross-piece 40 being named tab 411 while the remaining part is called the base 412.

Figure 9:
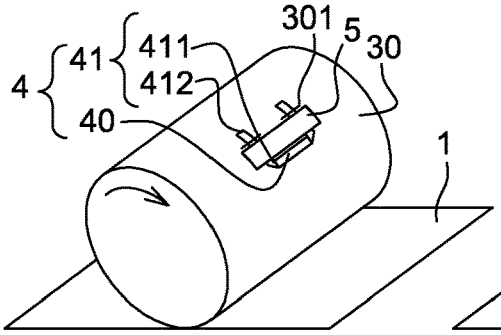
FIGS. 9 to 11 are perspective views of a detail of the machine of FIG. 8 in different stages of manufacture.
Figure 10:
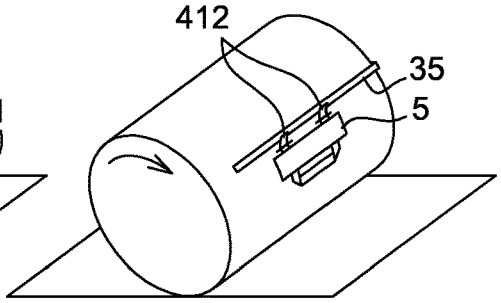

FIGS. 9-12 show the drum 30 schematically. The placement drum 30 includes grippers 301 for gripping each leg 41 of the handle 4 along future bending lines 410 between the base 412 and the tab 411. At the glue applying device 32, the glue is deposited on the bases 412. The station 3 furthermore comprises a rotatably mounted folding blade 34 and a folding bar 35 pivotally mounted slightly off-axis with respect to the drum axis 30. The function of the folding blade 34 may be carried out by the folding blade 371 of the turning roller 37. The folding bar 35 is mounted between a rear position as shown in FIGS. 8 and 10 and a folding position shown in FIG. 12 and in dashed lines in FIG. 8. The folding blade 34 is configured to form the bend, which also results in the raising of the bases 412 after same pass in front of the folding bar 35 in the retracted position, so that the bases 412 are driven by the folding bar 35 in the path thereof toward the folding position. The path of the folding bar 35 between these two positions is such that the folding bar 35 approaches the surface of the drum 30 as it moves from the retracted position to the folding position. The turning drum 37 can fulfil the role of the device 34 using the folding blade 371 and neutralizing the cross-piece gripper 370. The folding bar 35 can also be removable, to convert said machine into a machine according to the one of the first three embodiments according to the machine of the fourth embodiment. In this case, the gripper 302 is removable, for example, and is replaced by the gripper 301 to adjust the position and functionality thereof.

According to a first variant of the fourth embodiment, the machine further includes a device 33 for placing backing sheets 5 for placing a backing sheet 5 of each handle 4, by covering the tabs 411, as shown in FIG. 9, between the distribution roller 31 of the handles 4 and the operating range of the folding bar 35.

Figure 11:
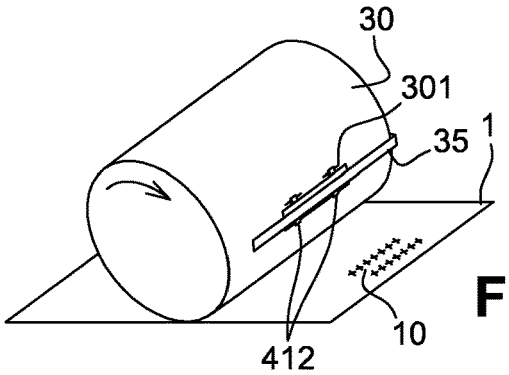
Figure 12:
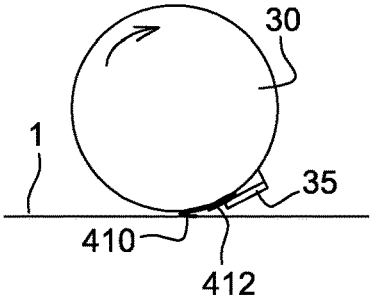
FIG. 12 is a side view of the detail of FIGS. 9 to 11 in a later stage.
Figure 13:
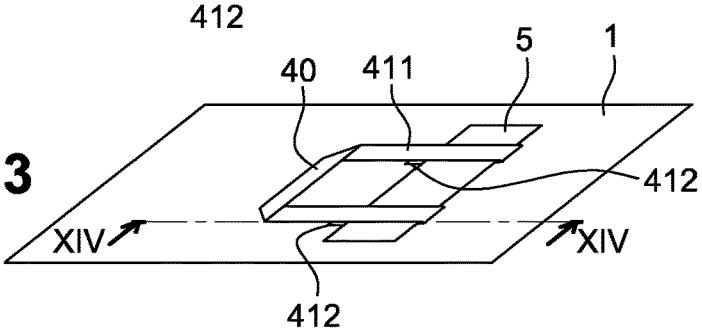
FIG. 13 is a perspective view of the hollow body receiving a handle according to the fourth embodiment.
Figure 14:
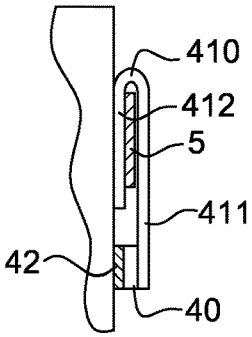
FIG. 14 is a sectional view of the bag of FIG. 13 according to plane XIV-XIV.

In operation, the hollow body 1 passes between the two drums 30 for placing the handles 4 and travels in the direction of the arrow F1, the drums 30 rotating synchronously with the hose 1. Each feed roller 31, places a strip to form a handle 4 on the drum 30 which then grips the handle 4 by the legs 41 with grippers 301. The cross-piece 40 is placed at the front relative to the direction of rotation of the drum 30. During rotation of the drum 30, the glue application device 32 places glue on the bases 412, the placement device 33 places the backing sheet 5 on the tabs 411 of the handle 4, as shown in FIG. 9. After the end of the legs 41 has exceeded the folding bar 35, the folding blade 34 lifts the base 412, while the folding bar 35 accelerates to catch up to the handle 4 by driving the bases 412 with it, so as to fold on the tabs 411 by trapping the backing sheet 5, as shown in FIG. 11. The folding bar 35 stops its movement upon reaching the folding position, just before the gap 36 between the two drums 30. At this position, the bases 412 are placed against the tabs 411, as shown in FIG. 12. The bases 412 and the backing sheet 5 come into contact with the wall 1 on which the bonding is carried out by pressing, being opposite a glued area 10 previously deposited on the hollow body by the bonding station 2. The grippers 301 release the legs 41 such that the handle 4 is transferred to the hollow body 1. A glued area on the wall comes into contact with the cross-piece 40 to thereby hold it against the wall, which forms holding means 42.

In a second variant of the fourth embodiment, shown in FIGS. 15 to 18, the backing sheet 5' is placed at a position such that it covers the legs 41 on either side of the fold line 410, and therefore both on the bases 412 and the tabs 411, so that same is folded with the bases 412 during the folding operation. The remainder of the method is identical to the fourth embodiment.

The resulting bag provides a backing sheet 5' bonded to the bag wall at the height of the bases 412 and a flap 50 which extends beyond the fold line 410, as shown in FIG. 18.

In a variant of the first embodiment, not shown, the legs 41 are folded on the distribution roller 31 and not on the drum 30. This arrangement permits the handle 4 to present the opposite side thereof once placed on the wall 1 compared to the embodiment shown in FIG. 3. This variant is also applicable to all other embodiments.

The invention is not limited to the embodiments described above as an example. The backing sheet 5 can be separated to be applied in two pieces, one for each base. It can also extend over the entire length of the bases, or even beyond or otherwise below the opposite ends of the fold line. The handles can be placed side-by-side on the web before the formation of the hollow body so that the handles are then found inside the bag.

The machine can be adapted to receive either the turning drum, or the folding station. The same machine can be easily modified to change the type of product bags. But the machine may also include, at the periphery of the placement drum, both the turning drum and the folding device, in an offset manner along the periphery. It is obvious that in this configuration, these devices are not in use simultaneously.

A reversal station can be interposed between the handle placement station and the hollow body forming station. The reversal station allows to reverse the top and bottom of the web 1*a*. Thus, the raised handles are found on the inside or outside of the bag.

The handle could be transported by means of transport between the placement drum 30 and the wall 1.

The invention claimed is:

1. A method of manufacturing a bag comprising:

passing a wall of a bag along a rotatably mounted placement drum for placing a handle on the bag, wherein the handle is hung on the placement drum, and legs of the handle extend along a perimeter of the placement drum, backward in a direction of rotation of the placement drum, the legs being connected by a cross-piece;

placing the handle on the wall;

wherein after the handle is hung on the placement drum and before the handle is placed on the wall, the handle is completely turned by a turning drum so that the legs are placed forward on the placement drum.

2. The method of manufacturing a bag according to claim 1, wherein, the cross-piece of the handle is grasped by the turning drum tangentially to a periphery of the placement drum to carry out the turning of the handle by the turning drum, the method further comprising inserting ends of the legs by a blade carried by the turning drum in a gripper of the placement drum and releasing the cross-piece by bringing the handle against the periphery of the placement drum.

3. The method of manufacturing a bag according to claim 1, wherein at least one backing sheet is placed by covering at least partially at least one leg before turning of the handle.

4. The method of manufacturing a bag according to claim 1, wherein a rotational speed of the placement drum is adjusted during rotation of one revolution to place the handle at a speed of the wall and at an interval separating two successive bags.

5. A machine for manufacturing bags with handles, the machine comprising:

a rotatably mounted placement drum that has a wall of the bag pass by, wherein the rotatably mounted placement drum places a handle on the wall;

an attachment that attaches the handle on the placement drum, wherein legs of the handle extending along a perimeter of the placement drum backward in a direction of rotation of the placement drum, the legs being connected by a cross-piece, the attachment being configured to place the handle on the wall; and a turning drum to turn the handle after the attachment attaches the handle on the placement drum and before placement of the handle on the wall and the legs are placed forward on the placement drum.

6. The machine according to claim 5, wherein, to carry out the turning of the handle, the turning drum is rotating and tangential to a periphery of the placement drum and comprises a cross-piece gripper to grasp the handle by the cross-piece during passage of the handle between the placement drum and the turning drum, and the machine further comprising a blade capable of inserting an end of the legs into a leg gripper of the placement drum, the cross-piece gripper being configured to release the cross-piece after grasping of the legs by the leg gripper, the machine further comprising a guide that returns the handle against a periphery of the placement drum, after the turning drum and before the placement of the handle on the wall.

7. The machine according to claim 5, further comprising a station for placing a backing sheet upstream of the turning drum for placing at least one backing sheet which at least partially covers at least one of the legs.

8. The machine according to claim 5, further comprising a control that controls a rotational speed of the placement drum upon rotation of one revolution and for placing the handle ata speed of the wall and at an interval separating two successive bags.

9. The machine according to claim 5, further comprising a station for forming a hollow body placed downstream of the placement drum.

10. The machine according to claim 5, further comprising a station for forming a hollow body placed upstream of the placement drum and a bottom forming station downstream of the placement drum.

11. The machine according to claim 5, further comprising a station for forming a hollow body placed upstream of a bottom forming station, which is upstream of the placement drum.

12. The machine according to claim 6, wherein the cross-piece gripper is neutralizable and the leg gripper of the placement drum is removable.

13. The machine according to claim 12, further comprising a folding bar pivotally mounted slightly off-axis with respect to a drum axis of the placement drum, and mounted between a retracted position and a folding position such that when the folding bar moves from the retracted position to the folding position, the folding bar approaches a surface of the placement drum, wherein the folding bar is removable, and wherein the machine further comprises secondary grippers for gripping each of the legs of the handle along future bending lines between a base of each of the legs and a tab of each of the legs.

* * * * *